US011047131B2

(12) United States Patent
Claeys

(10) Patent No.: US 11,047,131 B2
(45) **Date of Patent: *Jun. 29, 2021**

(54) CURTAIN WALL AND SET AND CONSTRUCTION METHOD FOR SUCH A CURTAIN WALL

(71) Applicants: Stephanie Catharina R. Claeys, Zandhoven (BE); Laurens Leonard J. Claeys, Zandhoven (BE); Nausikaa Els P. Claeys, Zandhoven (BE)

(72) Inventor: Eric Claeys, Zandhoven (BE)

(73) Assignees: Stephanie Catharina R. Claeys, Zandhoven (BE); Laurens Leonard J. Claeys, Zandhoven (BE); Nausikaa Els P. Claeys, Zandhoven (BE)

( * ) Notice: Subject to any disclaimer, the term of this patent is extended or adjusted under 35 U.S.C. 154(b) by 194 days.

This patent is subject to a terminal disclaimer.

(21) Appl. No.: 16/303,745

(22) PCT Filed: May 2, 2017

(86) PCT No.: PCT/BE2017/000027

§ 371 (c)(1),
(2) Date: Nov. 21, 2018

(87) PCT Pub. No.: WO2017/201589

PCT Pub. Date: Nov. 30, 2017

(65) Prior Publication Data

US 2020/0318346 A1 Oct. 8, 2020

(30) Foreign Application Priority Data

May 24, 2016 (BE) ..... 2016/5378

(51) Int. Cl.

| | |
|---|---|
| ***E04B 2/96*** | (2006.01) |
| ***E04B 2/90*** | (2006.01) |
| ***E04D 3/08*** | (2006.01) |

(52) U.S. Cl.
CPC ..... *E04B 2/965* (2013.01); *E04B 2/967* (2013.01); *E04B 2/90* (2013.01); *E04D 3/08* (2013.01);
(Continued)

(58) Field of Classification Search
CPC . E04B 2/965; E04B 2/96; E04B 2/967; E04B 2/88; E04B 2/90; E06B 1/524; E04D 3/08; E04D 2003/0837; E04D 2003/0868
See application file for complete search history.

(56) References Cited

U.S. PATENT DOCUMENTS 3,266,210 A * 8/1966 Grossman ..... E04B 2/96 52/690
3,527,012 A * 9/1970 Hemminger ..... E06B 7/14 52/665

(Continued)

FOREIGN PATENT DOCUMENTS

CL 201401909 7/2013
CL 201803326 11/2017

(Continued)

OTHER PUBLICATIONS

Machine translation of foreign reference DE10223038, obtained from https://patentscope.wipo.int/search/en/detail.jsf?docId=DE103607350&tab=PCTDESCRIPTION&_cid=P22-KDKKFU-50816-1 (last accessed on Aug. 7, 2020). (Year: 2020).*

(Continued)

*Primary Examiner* — Theodore V Adamos
(74) *Attorney, Agent, or Firm* — Bacon & Thomas, PLLC

(57) ABSTRACT

The curtain wall includes mullion profiles, transom profiles and one or more panels, where the mullion profiles extend vertically, where the transom profiles each are attached to two mullion profiles and extend horizontally, where the mullion profiles are provided with a groove on each side for (Continued)

receiving the side edge of a panel. The grooves have an access opening, where the access opening has a first fixed dimension or width in a horizontal direction, where the transom profiles have a second dimension in a horizontal direction and at right angles to the profile direction of the transom profiles, where the second dimension is larger than the first dimension, where the transom profiles have a third dimension in a non-horizontal direction at right angles to the profile direction, where the third dimension is smaller than the first dimension.

17 Claims, 13 Drawing Sheets

(52) U.S. Cl.
CPC ..... *E04D 2003/0837* (2013.01); *E04D 2003/0868* (2013.01)

(56) References Cited

U.S. PATENT DOCUMENTS

| | | | | | |
|---|---|---|---|---|---|
| 3,548,558 | A * | 12/1970 | Grossman | ..... | E04B 2/965 52/773 |
| 5,067,293 | A * | 11/1991 | Reynolds | ..... | E04B 2/88 52/235 |
| 7,779,584 | B2 | 8/2010 | Arias | | |
| 2004/0031220 | A1* | 2/2004 | Hocker | ..... | E04B 2/965 52/235 |
| 2006/0016137 | A1* | 1/2006 | Ferro | ..... | E04B 2/965 52/235 |
| 2013/0186031 | A1 | 7/2013 | Ting | | |

FOREIGN PATENT DOCUMENTS

| | | | | | |
|---|---|---|---|---|---|
| CN | 1479830 | A | 3/2004 | | |
| CN | 101137804 | B | 8/2010 | | |
| CN | 205153232 | U | 4/2016 | | |
| DE | 3313444 | A1 | 11/1983 | | |
| DE | 10223038 | A1 * | 12/2003 | ..... | E04B 2/965 |
| DE | 102014200247 | A1 * | 7/2015 | ..... | E06B 1/366 |
| EP | 0722023 | A2 | 7/1996 | | |
| GB | 2123052 | B | 1/1984 | | |
| GB | 2143558 | A | 2/1985 | | |
| WO | WO-9742380 | A1 * | 11/1997 | ..... | E06B 3/68 |
| WO | 2017201587 | A | 11/2017 | | |

OTHER PUBLICATIONS

Machine translation of foreign reference DE102014200247, obtained from https://translationportal.epo.org/emtp/translate/?ACTION=description-retrieval&COUNTRY=DE&ENGINE=google&FORMAT=docdb&KIND=A1&LOCALE=en_EP&NUMBER=102014200247&SRCLANG=de&TRGLANG=en (last accessed on Aug. 7, 2020) (Year: 2020).*

Chilean Examiner Report in corresponding Chilean Application No. 201803325, dated Apr. 8, 2020.

Eurasian Office Action in corresponding Eurasian Application No. 201892718, dated Apr. 11, 2019.

Chinese Office Action in corresponding Chinese Application No. 2017800317348, dated Apr. 8, 2020.

Chilean Search Report in corresponding Chilean Application No. 201803325, dated Apr. 8, 2020.

International Search Report in related PCT/BE2017/000027, dated Oct. 24, 2017.

Written Opinion in related PCT/BE2017/000027, dated Oct. 24, 2017.

Belgium Search Report in related Belgium Application No. 201605378, dated Nov. 28, 2016.

Indian Office Action in corresponding Indian Application No. 201837044301, dated Mar. 10, 2021.

* cited by examiner

CURTAIN WALL AND SET AND CONSTRUCTION METHOD FOR SUCH A CURTAIN WALL

BACKGROUND OF THE INVENTION

1. Field of the Invention

The present invention relates to a curtain wall and a set and construction method for such a curtain wall.

A curtain wall is a structure of mullion profiles and transom profiles in which panels, usually glass panels, but possibly also closed panels, can be placed to form a non-load-bearing outer wall.

A disadvantage of the known curtain walls is that the mullion profiles and transom profiles are designed to be built from the outside to form a structure of profiles. Also, the panels must then be installed from the outside. This is complex, especially when construction must be done at certain heights and requires scaffolding or suspended working platforms and it is dangerous for the persons who perform this work and for those who might pass under it.

An installation of the panels from the inside would be much easier and safer because there are floors at regular intervals.

Also, the known systems of mullion profiles and transom profiles require a large number of components and a large number of actions to assemble them.

2. Related Art

From U.S. Pat. No. 3,266,210 a curtain wall structure is already known with transom profiles mounted between the mullion profiles and whose assembly of the mullion profiles and the transom profiles can be performed from within.

With this known structure, the transoms are snapped into place in the mullions, which, as a disadvantage, can cause the transoms to come back loose, with all the disastrous consequences thereof.

Another important disadvantage of this known structure is that it does not solve the problem of tolerances.

In the case of a curtain wall, two types of tolerances can be distinguished, on the one hand, the manufacturing tolerances due to the limitations associated with accuracy in production, and, on the other hand, the construction tolerances due to the installation in situ.

In addition, the transom profiles must be mounted at their ends between the mullion profiles in order to allow for the thermal dilatations of the transom profiles on the one hand, and the differential settlements of a building, which are inevitable and inherent to a concrete or steel structure, on the other hand.

However, this engenders to the connection between the mullions and the transoms not being watertight, which can result in leaks, which is obviously inadmissible for a facade.

The curtain wall structure does not provide a seal between the mullions and the transoms, because of the specific assembly method by rotating the transoms, this method does not provide enough space for a seal to be applied at that place.

Moreover, a seal using an elastic kit would not offer a durable solution at that place, given the metal to metal connection and the inevitable thermal expansion and shrinkage of the metal transoms.

Additionally, this structure does not allow for tolerances, such as are inevitable in the production and assembly.

SUMMARY OF THE INVENTION

The object of the invention is to provide a solution to the aforementioned and other disadvantages and relates thus to a curtain wall comprising mullion profiles, transom profiles and one or more panels, wherein the mullion profiles extend vertically, wherein the transom profiles are each attached to two mullion profiles and extend horizontally, wherein the mullion profiles are provided on each side with a groove to receive the side edge of a panel, wherein the grooves have an access opening, wherein the access opening has a first fixed dimension or width in the horizontal direction, wherein the transom profiles in the horizontal direction and at right angles to the profile direction of the transom profiles, have a second dimension, wherein the second dimension is larger than the first dimension, wherein the transom profiles in a non-horizontal direction at right angles to the profile direction have a third dimension, wherein the third dimension is smaller than the first dimension, so that the ends of the transom profiles, in a rotated state of the transom profiles in which the direction of the third dimension is horizontal, pass through the access opening and wherein the transom profiles are provided with an undercut groove which runs in the profile direction and with a rod inserted in the undercut groove, wherein the mullion profiles are provided with a second groove for receiving an end of said rod projecting out from the undercut groove, thereby blocking a rotational movement of the transom profiles. Here, the mullion profiles are made of a single piece or of multiple connected non-detachable sub-profiles, creating a fixed size for the width of the aforementioned access opening.

Such a curtain wall is easy to build from the inside without requiring many actions, because the aforementioned features allow the transom profiles to be placed in a groove around their longitudinal axis, and then simply get their desired orientation by rotation and allow them to be fixed in the grooves.

An advantage of a curtain wall according to the invention is that during the construction of the curtain wall, the transom profiles can be secured by a simple shift of a rod or slat preventing the detachment from between the mullion profiles by a rotation of the transom profiles in the opposite direction than during the installation.

In a preferred embodiment, one or more walls of the grooves are provided with a recess in which a section of the transom profiles are located, wherein the transom profiles are vertically supported by a bottom edge of said recess.

This is an easy way to get the transom profiles fixed to the mullion profiles without further attachments. In addition, such a suspension allows the transom profiles to have some play in their profile direction, which is desirable to accommodate stress in the curtain wall.

In a further preferred embodiment, the transom profiles are Z-profiles with a first vertical leg directing upward and located on the inside of the transom profile and a second vertical leg directing downward and located on the outside of the transom profile and a horizontal intermediate section between the first and second leg.

Due to the vertical legs, sufficient rigidity is obtained, while the horizontal intermediate section allows sufficient space for installing a panel above the transom profile.

Preferably, the aforementioned undercut groove, including the rod for blocking the rotation of the transoms, is mounted on the inside of the second leg.

This makes it easy to shift the rod from the inside when building the curtain wall, in other words from a floor against which the curtain wall is constructed.

Preferably, the mullion profiles and the transom profiles are composite profiles, each of which is composed of two or more sub-profiles, the sub-profiles not necessarily being made of the same material.

This results in good thermal insulation, for example by working with an aluminium outer and inner sub-profile, connected by insulating plastic profiles.

Preferably, said grooves on the different sides of the mullion profiles have a different depth.

This also allows the panels to be placed from the inside by shuffling a panel into the deepest groove, then shifting it into the desired orientation and then shuffling it towards the shallow groove.

Preferably the panels are glass panels.

In a still another preferred embodiment, a barrier for water is provided at the fixing points of the transom profiles on the mullion profiles, wherein the barrier is adapted to divert this water to a said transom profile, wherein the transom profiles are adapted to drain this water to the exterior of the curtain wall.

Here, the exterior of the curtain wall is the side exposed to atmospheric influences.

The advantage is that the mullion profiles do not need to be equipped with water drainage openings, but that any infiltration water in the curtain wall can be evacuated for each facade plane separately, as opposed to traditional curtain walls, where infiltration water is collected and drained across multiple facade planes.

This also results in a vertical and horizontal sealing of the mullion profiles for each panel, so that any possible water leak can be assigned with certainty to a problem with respect to the placement of that particular panel or the mullion profiles or transom profiles around that particular panel and finding and solving a problem is thus much easier.

While in the traditional curtain walls water is led from the transom profiles to the mullion profiles and drained from there, the curtain wall according to the invention is designed to guide water from each panel separately from the mullion profiles to the transom profiles and to drain the water therefrom.

Preferably, the grooves are rectangular in shape in horizontal cross-section, their access opening not taken into account. This makes it easier to fit the shape of the groove to the shape of a waterproofing barrier to ensure good waterproofing and to easily install such barriers along with the transom profiles.

Preferably, the transom profiles are designed to drain said water to the outside of the curtain wall because the transom profiles, or a different profile attached to the transom profiles, such as for example glazing beads, are equipped with water drainage openings on the outside, wherein these drainage openings are located at a distance from the mullion profiles. Preferably this distance is between 10 and 300 mm.

In a further preferred embodiment, the transom profiles are designed in such a way that the section of the transom profiles to which said water is diverted, is positioned horizontally or slanting to the outside, wherein the transom profiles comprise a sub-profile made in one piece; the sub-profile being part of said section to which said water is diverted and wherein the sub-profile is provided with an upright edge on the inside of said section.

The section is made of a single piece of aluminium and is therefore waterproof. Thanks to the upright edge, inward leakage is prevented, even if a small amount of water should come onto the transom profiles, as long as this amount does not rise above the edge.

In a still another preferred embodiment, the barriers are formed by pre-assembled flexible plastic or rubber sealing pieces, wherein the sealing pieces are placed on ends of the transom profiles prior to the installation and wherein the shapes of the mullion profiles and the sealing pieces are adapted to each other to achieve a watertight connection between the transom profiles and the mullion profiles at the locations of the aforementioned attachment points.

Such sealing pieces are a practical way of obtaining such a barrier, are durable over time and can accommodate any possible small movement of the curtain wall.

The pre-assembled sealing pieces are thereby slid close-fittingly over the ends of the transom profiles, each sealing piece fit sealingly in an aforementioned undercut groove of two opposing mullions and thus forming a seal between the ends of the transom profiles and the corresponding mullion profiles.

In this manner, the play between the mullion profiles and the ends of the transom profiles can be sealed watertight. Indeed, such play must be inherently present to accommodate the inevitable shrinkage and expansion of the transom profiles.

Due to the pre-assembled fitting sealing pieces, the connection between the mullion profiles and the transom profiles is automatically achieved when mounting the transom profiles between the mullions without requiring any additional actions.

In yet another preferred embodiment, the sealing pieces are provided with a deformable hollow chamber to facilitate the placement of the transom profiles onto which such sealing pieces are mounted.

Thanks to this deformable chamber, the sealing pieces can be deformed during the installation, facilitating the installation given the small space available in the grooves of the mullion profiles to allow rotation of the sealing profiles in these grooves when mounting the transoms between the mullions, and the fact that the sealing pieces must be able to fill the width of these grooves after assembly to ensure the necessary sealing.

In a further preferred embodiment, a sealing piece is provided at each of the two ends of the transom profiles, wherein at least one, and preferably exactly one, of the sealing pieces of a transom profile is slidable on the transom profile in the profile direction of this transom profile, preferably over a distance of at least 1 and up to 12 mm, in order to accommodate small movements.

Under the influence of the wind and over time, small deformities can occur in the curtain wall. In order to ensure that these do not lead to high stress, which could lead to a breakage, said slideability is desirable.

Consequently, unavoidable differences in length of the transom profiles can be accommodated without compromising the waterproofness of the sealing pieces between the mullions and the transoms.

Preferably, the sealing pieces comprise a flat end wall that is perpendicular to the profile direction of the transom profiles, wherein the end wall is completely closed is in the profile direction of the transom profiles and the end wall is resting against a mullion profile, so that the ends of the transom profiles are fully encased in the sealing pieces.

In a further preferred embodiment, the sealing pieces comprise a flat end wall that is perpendicular to the profile direction of the transom profiles, wherein the end wall is completely closed in the profile direction of the transom profiles and the end wall is resting against a mullion profile, more specifically the bottom of a groove of a mullion profile.

This prevents any possible infiltration water from flowing past the sealing pieces and seeping downwards.

In yet another preferred embodiment, the mullion profiles and the transom profiles define rectangular openings, wherein one or more panels are positioned in said openings thus closing these openings, wherein the one or more panels are secured by means of first glazing beads attached to the aforementioned mullion profile by means of first attachment aids, wherein the first attachment aids and the mullion profiles are configured to secure the first attachment aids, preferably by snapping them into place, to a said mullion profile, wherein the first attachment aids and the first glazing beads are adapted to secure the first glazing beads to the first attachment aids.

In this way, first glazing beads can be easily attached simply by snapping them into place. This allows the panels to be fitted from the inside.

This also allows greater freedom in the design of the mullion profiles, because the placement possibility for first glazing beads is already provided. The first attachment aids can already be installed prior to a panel, while a glazing bead can only be installed later, thus limiting the connection possibilities of a glazing bead directly to a mullion profile.

In yet another preferred embodiment, the first attachment aids are made of plastic and the first glazing beads are made of aluminium.

Thanks to plastic first attachment aids, costs can be saved on the relatively expensive aluminium.

In a further preferred embodiment, the first attachment aids and the aforementioned mullion profiles are designed to snap the first attachment aids into a said mullion profile in a direction perpendicular to the plane of the panel in question, wherein the first attachment aids and the first glazing beads are adapted to snap the first glazing beads into the first attachment aids in a direction parallel to the plane of the respective panel.

In yet another preferred embodiment, the first attachment aids are profiles extending over only a portion of the length of the first glazing beads.

In yet another preferred embodiment, the first glazing beads are each secured to a mullion profile by a minimum of two first attachment aids that are placed some distance apart.

In yet another preferred embodiment, the one or more of the aforementioned mullion profiles and the first glazing beads are designed in such a way that the first glazing beads rest, with their side facing away from the respective panel, against the mullion profile.

In yet another preferred embodiment, the one or more panels are secured by means of second glazing beads, that are attached to an aforementioned transom profile by means of the second attachment aids, wherein the second attachment aids and one or more of said transom profiles are adapted to attach the second attachment aids to the transom profile, wherein the second attachment aids and the second glazing beads are adapted to snap the second glazing beads into the second attachment aids.

The advantages mentioned with reference to the first glazing beads and the mullion profiles are therefore also applicable to the transom profiles and the second glazing beads.

The invention also relates to a set for the construction of a curtain wall, wherein the set comprises two or more mullion profiles and two or more transom profiles, wherein the mullion profiles have an outer side, an inner side and two sides, wherein the mullion profiles are provided on each side with a groove in order to receive the side edge of a panel, wherein the grooves have an access opening, wherein the access opening has a horizontal first dimension, wherein the transom profiles have a horizontal second dimension perpendicular to the profile direction of the transom profiles, wherein the second dimension is larger than the first dimension, wherein the transom profiles have a third maximum dimension in a non-horizontal direction at right angles to the profile direction, wherein the third dimension is smaller than the first dimension and wherein the transom profiles (14) are provided with an undercut groove (30) that extends in the profile direction and a rod (32) inserted in the undercut groove (30) and wherein the mullion profiles (5) are provided with a second groove (13) for receiving an end of said rod (32) projecting out from the undercut groove (30), thereby blocking any rotational movement of the transom profiles (14).

Such a set can easily be assembled into a curtain wall, with similar advantages as described above.

In a preferred embodiment, the set also includes a tool with a head and a lever attached to the head, wherein the shape of the head is complementary to the shape of the transom profile so that the head can be closely fitted onto the transom profile.

Here, the lever is attached to the head in such a way that when the head is fit onto the transom profile, the lever is a lever in a direction at right angles to the profile direction of the transom profile so that, thanks to the lever, a rotational force can be applied to the transom profile.

The invention further relates to a construction method for a curtain wall, in which mullion profiles are placed vertically, in which then between a pair of adjacent mullion profiles a transom profile is placed horizontally with one side of the transom profile projecting upwards, wherein this transom profile is placed by sequencing the next steps:

Step A) the transom profile is held in the vertical plane defined by the mullion profiles in a non-horizontal orientation and rotated relative to the desired end orientation of the transom profile on an axis parallel to the profile direction of the transom profile;

Step B) the transom profile is brought to a horizontal orientation in the vertical plane defined by the mullion profiles;

Step C) the transom profile is rotated to the desired end orientation on said axis while the transom profile remains in a horizontal orientation;

Step D) blocking the rotation of the transom profile around said axis by shifting a rod (32) in the undercut groove (30) of the transom profile (14) into a second groove (13) of a mullion profile (5).

The final orientation of the transom profile, that is to say, which side should be on top, is imposed externally on the invention and follows from the curtain wall design.

In a preferred variant, in step C, the transom profile is snapped into recesses, provided into the mullion profiles for this purpose.

In a preferred variant, in step C, a tool is used with a head and a lever attached to the head, wherein the shape of the head is complementary to the shape of the transom profile, wherein the head is fitted onto the transom profile and wherein via the lever a rotational force can be applied to the transom profile.

Above, references to orientations such as horizontal, vertical, inside, outside, side, etc. are considered as orientations in the assembled state.

BRIEF DESCRIPTION OF THE DRAWINGS

With the intention of better showing the characteristics of the invention, a preferred configuration according to the present invention is described hereinafter by way of an example, without any limiting nature, with reference to the accompanying drawings, wherein:

FIGS. 2 and 3 schematically represent a cross-sectional view of the curtain wall of FIG. 1 taken along line II-II, in which parts are omitted for clarity's sake in both figures;

DETAILED DESCRIPTION OF THE INVENTION

The curtain wall 1 shown in FIGS. 1 to 5 consists of a structure of vertical mullions 2 between which horizontal transoms 3 are attached. In the openings formed by the mullions 2 and the transoms 3, panels are placed, in this example, but not necessarily, glass panels 4, which are seated with their edges in the mullions 2 and the transoms 3.

Figure 6:
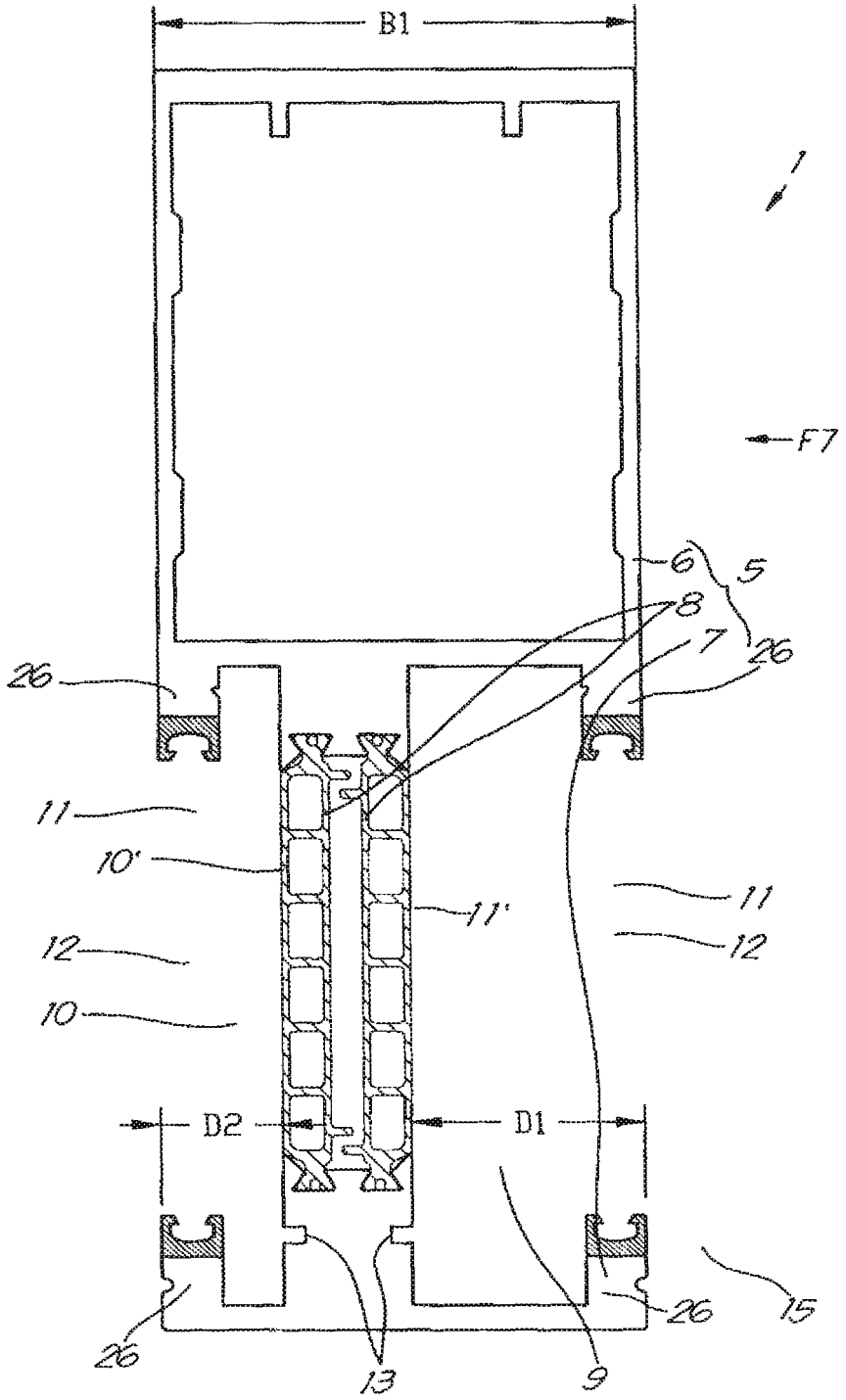
FIG. 6 schematically represents a part of the curtain wall of FIG. 1 and shows a step in the manufacturing procedure of the curtain wall of FIG. 1.

The mullions 2 are formed by mullion profiles 5 with a width B1 of 56 mm. The mullion profiles 5 are shown separately in a cross-sectional view in FIG. 6.

The vertical mullion profiles 5 consist of four sub-profiles, namely an aluminium tubular sub-profile 6 on the inside, an aluminium sub-profile 7 on the outside and two plastic insulation profiles 8. These four sub-profiles 6, 7, 8 are assembled into a monolithic entity by means of rolling, i.e. mechanical deformation of lips on the aluminium sub-profiles 6, 7 to clamp the plastic profiles 8.

Figure 1:
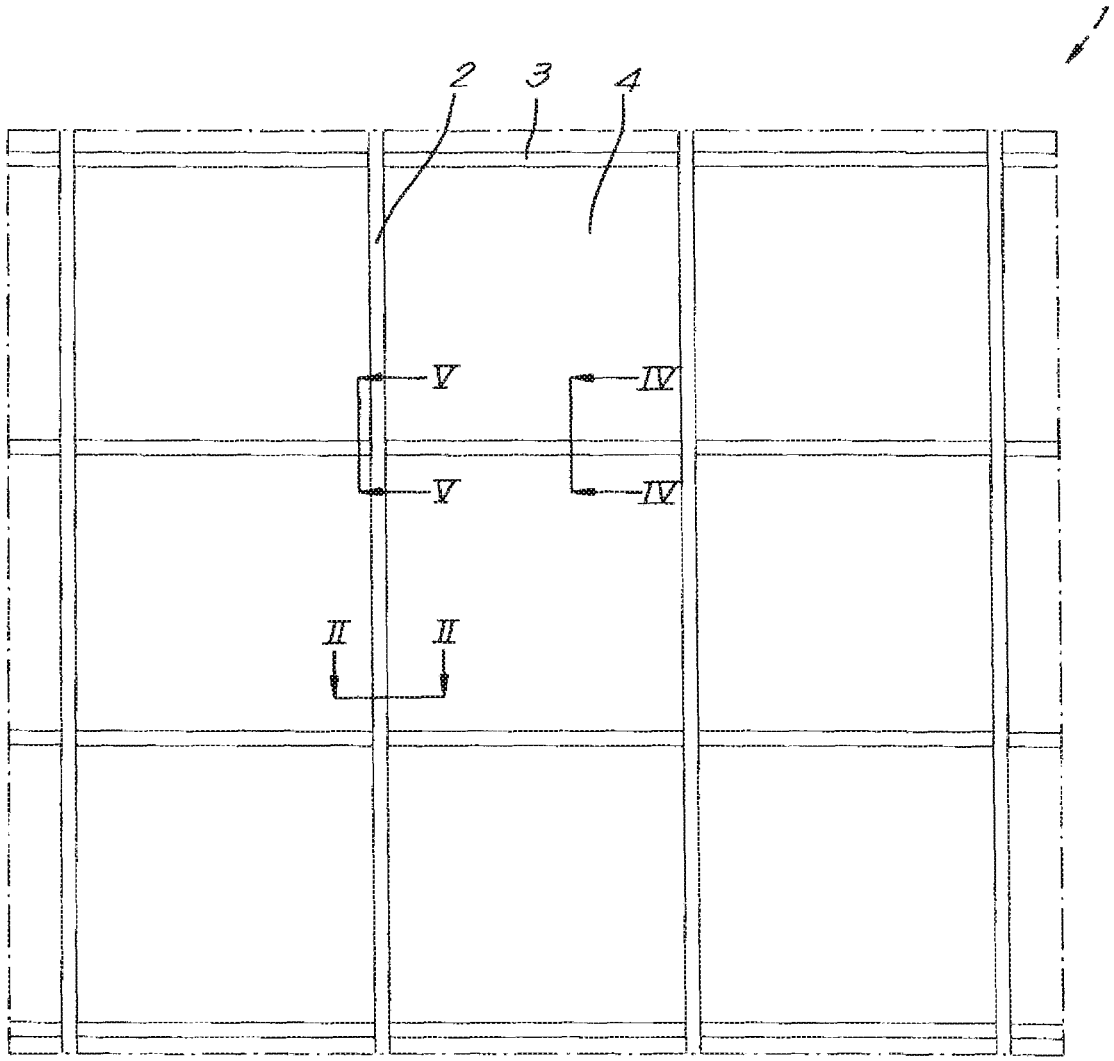
FIG. 1 schematically represents an outer view of a curtain wall according to the invention.
Figure 2:
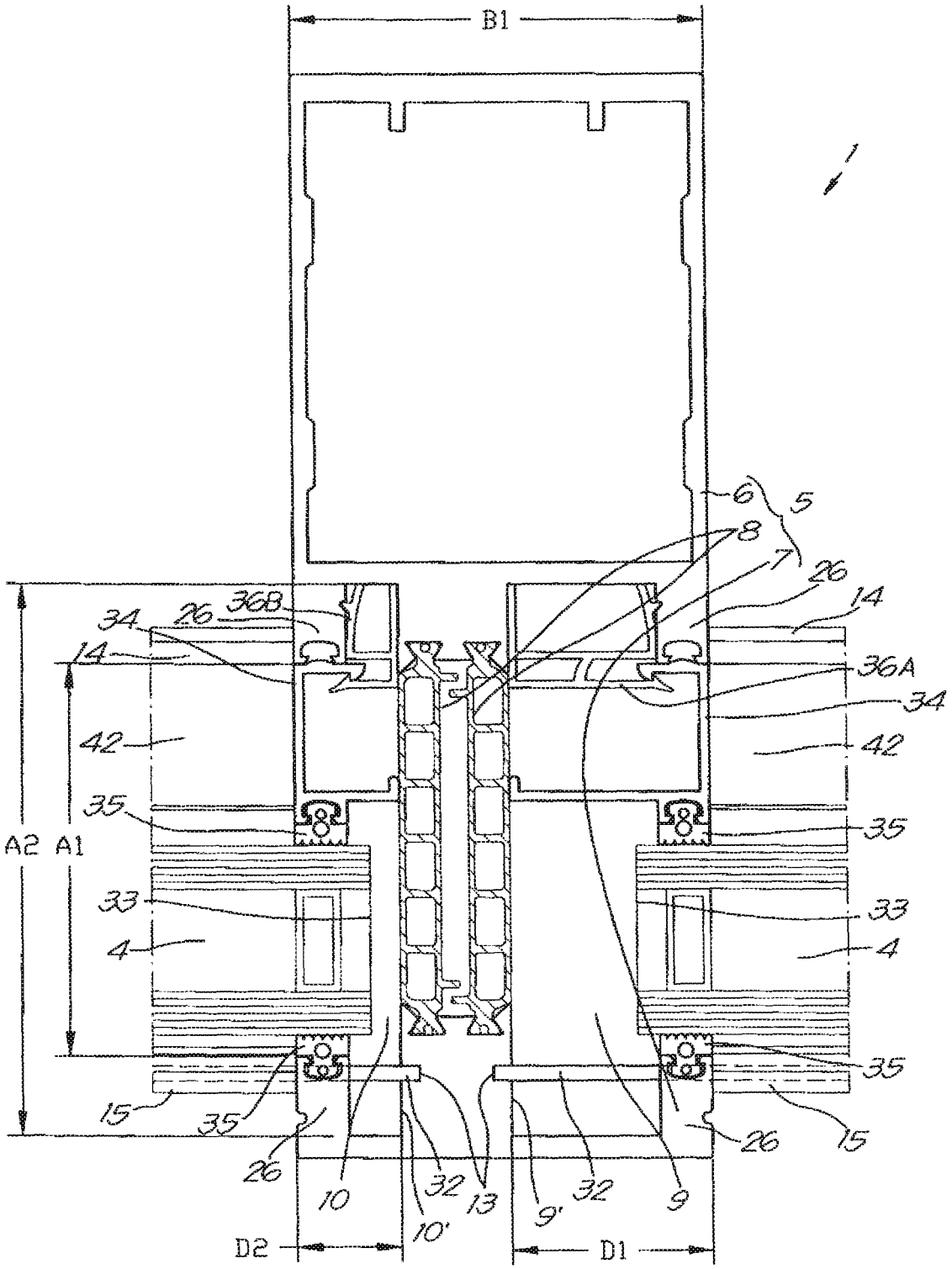

The mullion profiles 5 have a lateral undercut groove on both sides, namely a deep lateral groove 9 on one side, in FIGS. 2 and 3 on the right side, and a shallow groove 10 on the other side. The deep lateral groove 9 has a depth D1 of 28 mm, and the shallow lateral groove 9 has a depth D2 of 14 mm.

Both grooves 9 and 10 serve as a rabbet 11 for the side edges of the panels 4. The access opening 12 of the lateral grooves 9, 10 has a horizontal dimension, which is 54 mm wide. The maximum horizontal dimension A2 of the lateral grooves 9, 10 is approximately 76 mm.

The sub-profiles 6, 7 and 8 of the mullion profiles 5 are inseparably connected to each other, which means that they cannot be uncoupled from each other without causing irreversible damage. This means that the grooves 9 and 10 cannot be opened without damage and thus that the width A1 of the access opening 12 is a fixed size. At the bottom 9' and 10' of the two lateral grooves 9, 10 a narrow second groove 13 is provided.

The transoms 3 are mainly formed by transom profiles 14 onto which an aluminium glazing beads 15 are attached to the outside of the curtain wall 1. The transom profiles 14 are shown separately in a cross-sectional view in FIG. 8.

The transom profiles 14 are Z-shaped profiles, having a first vertical leg 16 on the inside, a second vertical leg 17 on the outside and a section 18 between both legs 16, 17.

The transom profiles 14 have a total height H1 of 56 mm and a horizontal dimension A3 of 64 mm.

Figure 8:
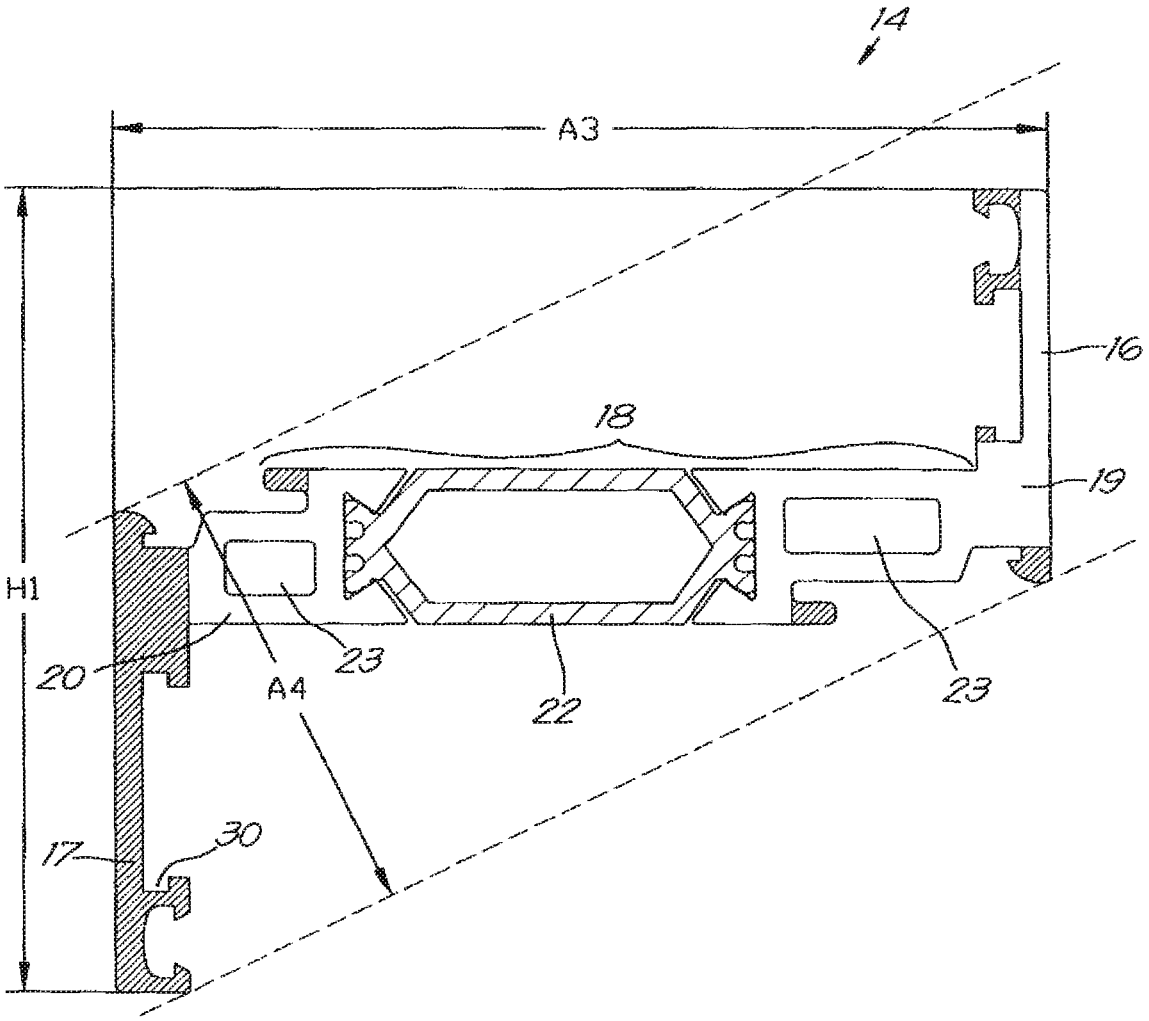
FIG. 8 schematically represents a part of the curtain wall of FIG. 1 and shows a step in the manufacturing process of the curtain wall of FIG. 1.

It is important to note that in a slanting direction, deviating approximately 60° from the horizontal direction, the transom profiles 14 have a much smaller dimension A4 of about 34 mm as shown in FIG. 8.

The transom profiles 14 consist of three sub-profiles, namely an aluminium inner sub-profile 19, a portion of which forms the first leg 16, an aluminium outer sub-profile 20, a portion of which forms the second leg 17 and a plastic insulation profile 22. These three sub-profiles 19, 20, 22 are firmly attached to each other by means of rolling, i.e. mechanical deformation of lips on the aluminium sub-profiles 19, 20 in order to clamp the plastic profiles 22.

The inner and outer section profiles 19, 20 are each provided with an internal chamber 23.

Figure 4:
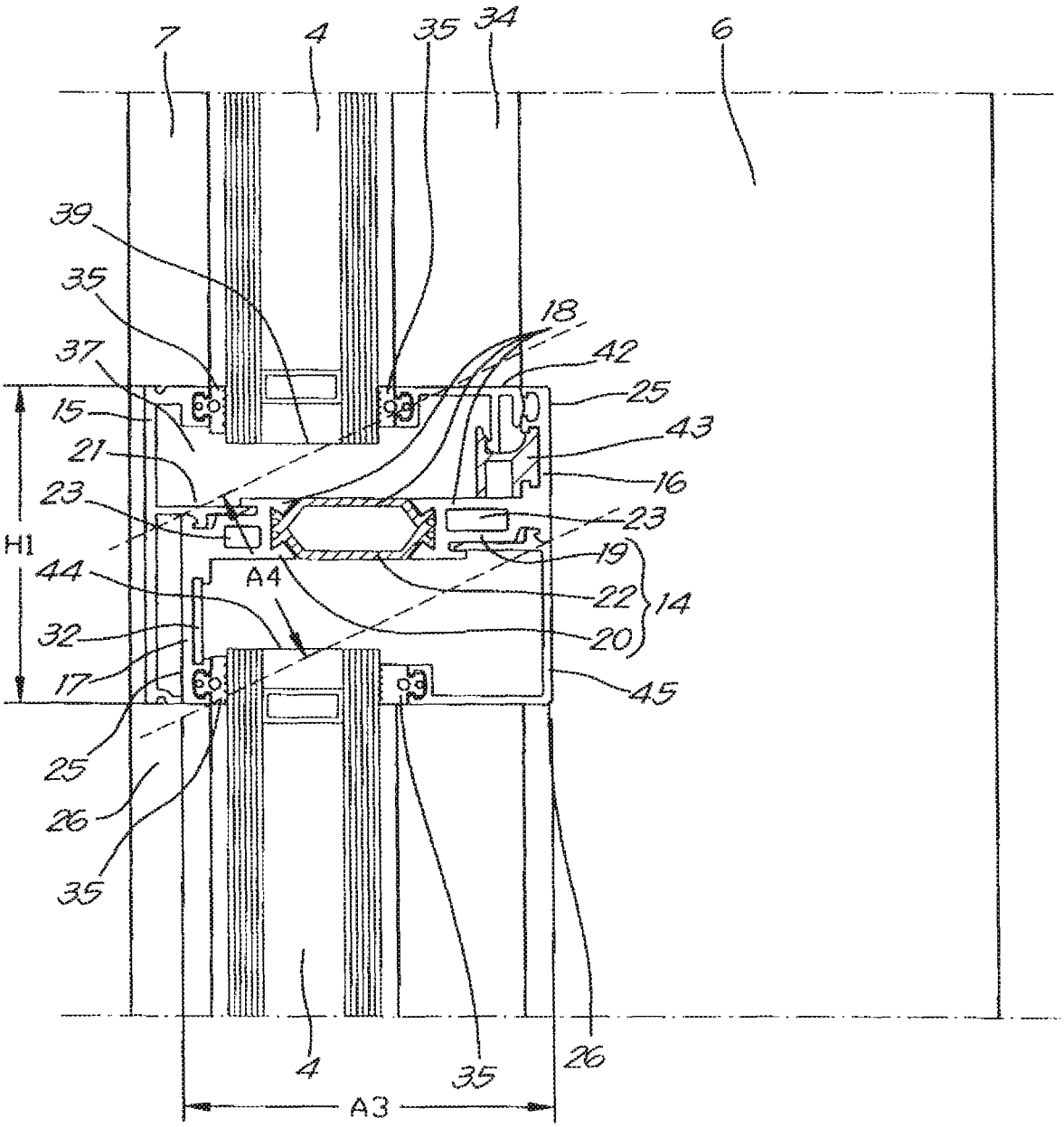
FIG. 4 schematically represents a cross-section of the curtain wall of FIG. 1 along line IV-IV.
Figure 5:
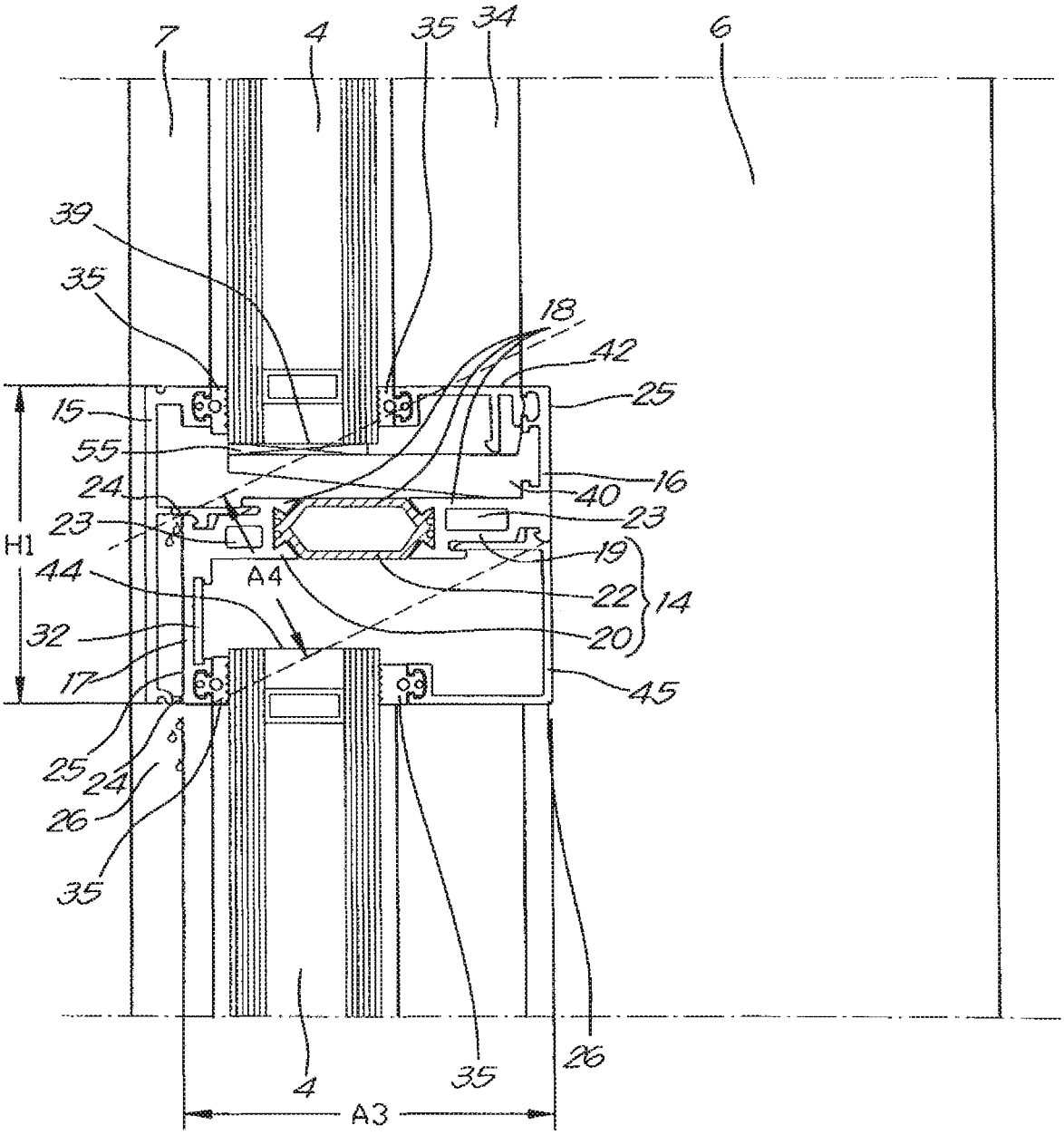

As illustrated in FIG. 4, the glazing beads 15 are provided with clipping parts 21 or other fastenings in order to attach them to the transom profiles 14, for example against the vertical leg 17 on the outside of the curtain wall 1.

Figure 5:
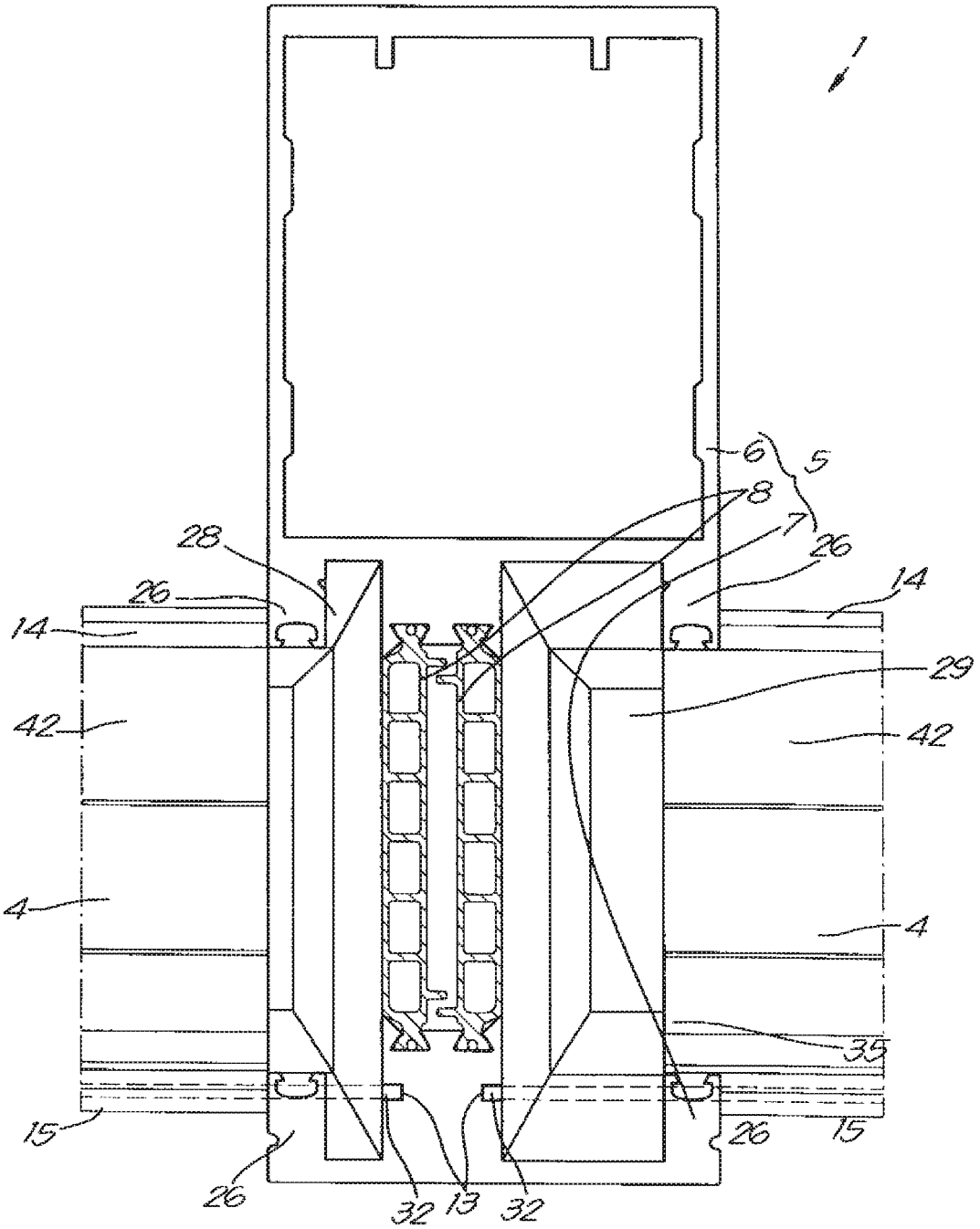
FIG. 5 schematically represents a cross-section of the curtain wall of FIG. 1 along line V-V.

As is particularly apparent from FIG. 5, the glazing beads 15 are provided with water drainage openings 24 at a small distance from the mullion profiles 5. Such drainage openings 24 may additionally also be provided in one or more other locations in the glazing beads 15. This depends on the length of the transoms 3.

Figure 7:
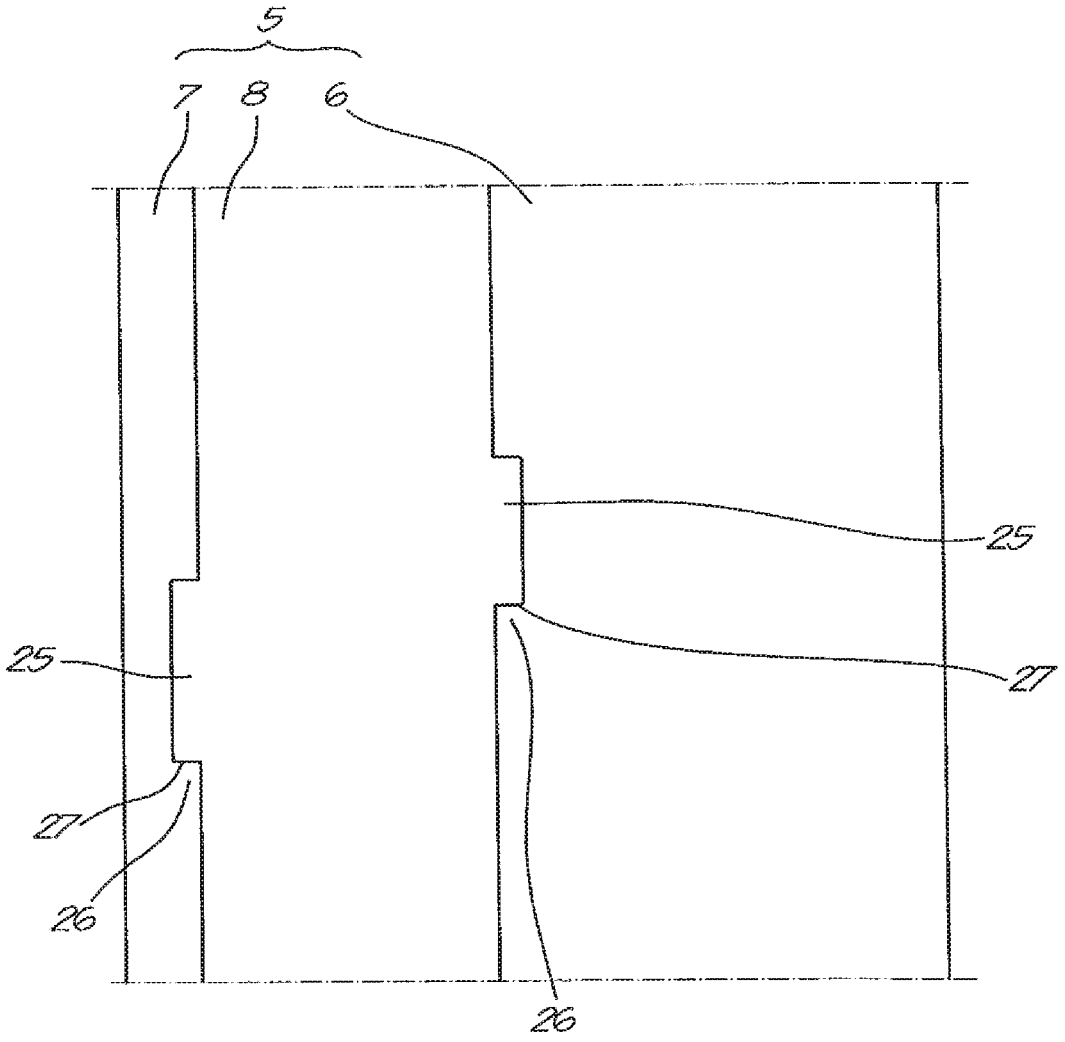
FIG. 7 schematically represents the result of the step of FIG. 6 in a view according to F7.
Figure 11:
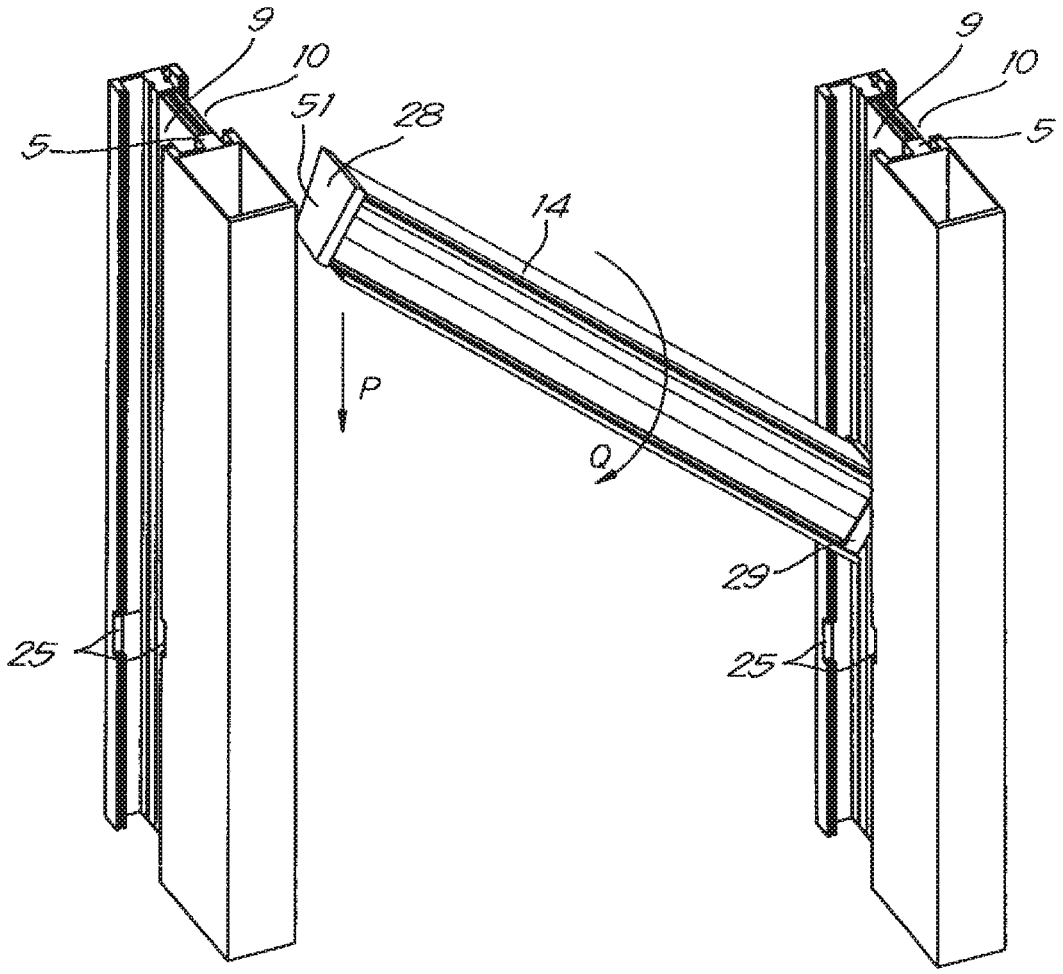
FIG. 11 schematically shows a next step in the manufacturing process of the curtain wall of FIG. 1 in perspective.

The transom profiles 14 are attached to the mullion profiles 5 because parts of the transom profiles 14, and more specifically the first and second legs 16, 17, rest in the recesses 25 shown in FIGS. 7 and 11 in the walls 26 of the lateral grooves 9, 10 of the mullion profiles 5 and are vertically supported by the bottom edge 27 of these recesses 25. How this is achieved will be explained later.

At the ends of the transom profiles 14, sealing pieces 28, 29 are provided that are made of rubber with a Shore hardness of 75. These sealing pieces 28, 29 fit exactly into the lateral grooves 9, 10 of the mullion profiles 5 and seal these grooves 9, 10 off in the vertical direction to prevent possible infiltration water coming into grooves 9 and 10 and constitute as such a vertical barrier, so that the water cannot possibly pass through to an underlying module—the so-called waterfall principle or cascade drain, but possible infiltrated water is individually drained from each panel (or facade plane) separately.

The transom profiles 14 are preferably equipped to drain this water to the outside of the curtain wall 1, with the upper side of the transom profile 14 slanting downwards to the outside of the curtain wall 1, for example.

The raised leg 16 on the inside of the curtain wall prevents water from infiltrating to the inside.

Figure 9:
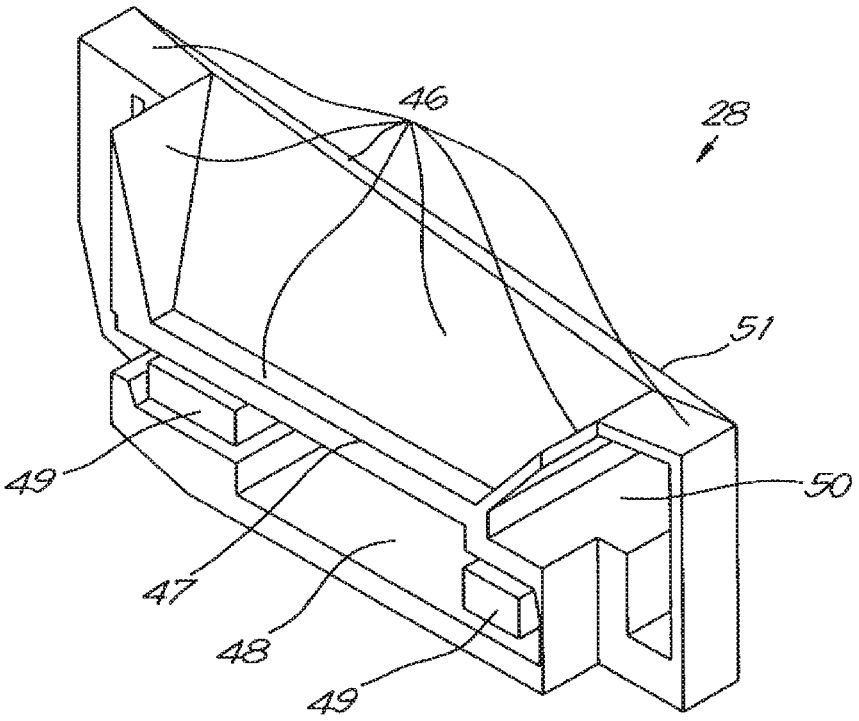
FIGS. 9 and 10 schematically show parts of the curtain wall of FIG. 1 in perspective.
Figure 10:
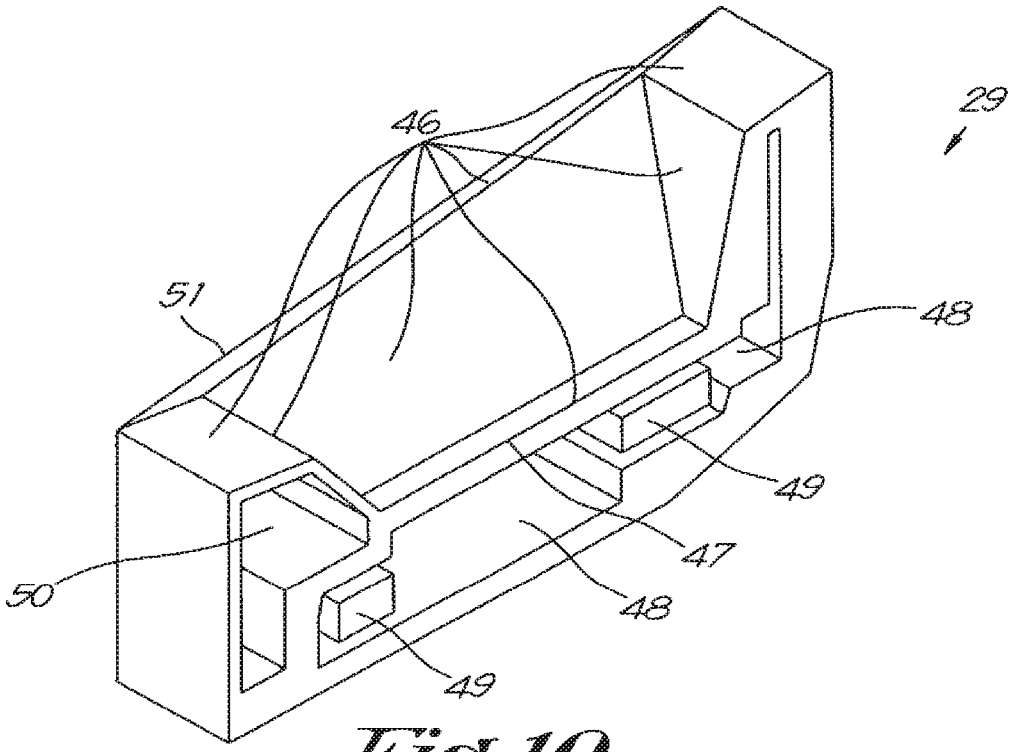

Details of these sealing pieces 28, 29 and the manner in which they are attached to the transom profiles 14 will be addressed later. These sealing pieces 28 and 29 are shown in FIGS. 3, 9 and 10 and are preferably manufactured in a single piece by injection moulding or the like.

In order to secure the attachment of the transom profiles 14 to the mullion profiles 5, the transom profiles 14 on the inside of the second leg 17 are provided with an undercut groove 30. At one or both ends of this undercut groove 30 is a rod, in this example an aluminium slat 32 mounted in the groove 30 so that it can be slid in the groove. When mounted, the slat 32 extends beyond the undercut groove 30 with a protruding end, said end is fitted in a second groove 13 of the mullion profiles 5 and acts as a lock.

Due to the fact that the groove 30 and the slat 32 are located on the inside of the outer vertical leg 17 of a transom profile 14, the transom profile 14, in its end position, can be locked from the inside during the construction of the curtain wall 1 by sliding slat 32 from a groove 30 into a groove 13 of a mullion profile 5.

The side edges 33 of the glass panels 4 are secured in the lateral grooves 9, 10 of the mullion profiles 5 by being fitted between the outer profile 7 of the mullion profiles 5 and the vertical glazing beads 34 on the inside of curtain wall 1. In this setup, rubber gaskets are placed between the outer profile 7 and the glass panels 4, and between the vertical glazing beads 34 and the glass panels.

Glazing beads are profiles made out of a rigid material and which serve with the aid of a gasket to accommodate the play between the thickness of the panels 4 and the width A1 of the rabbet 11 or rather: to accommodate the differences in thickness between thicker or thinner panels. These glazing beads have a width that has to be adjusted to the thickness of the panels that are to be installed.

The vertical glazing beads 34 are attached to the mullion profiles 5 by means of first attachment aids 36, used in two variants, namely a first variant 36A for use in the deep lateral groove 9 and a second variant 36B for use in the shallow lateral groove 10.

These first attachment aids 36 are PVC profiles with a profile length of approximately 3 cm. At a distance of approximately 60 cm, they are snapped onto the mullion profiles 5 and the vertical glazing beads 34 are in turn snapped onto the first attachment aids 36.

The glazing beads 15 protrude to a certain height above the section 18 of the transom profiles 14 and together with the upwardly directed leg 16 of the transom profiles 14, they form a rabbet 37 for the lower edge 39 of an upper glass panel 4.

The lower edge 39 of the glass panels 4 is supported by glass supports 40 that are attached to the first leg 16 of the transom profiles 14, near the mullion profiles 5, as shown in FIG. 5.

The lower edge 39 of the glass panels 4 is fitted between the glazing beads 15 on the outside of the curtain wall 1 and a horizontal glazing bead 42 on the inside. There are rubber gaskets 35 inserted between the glazing beads 15 and the glass panels 4 and between the horizontal glazing beads 42 and the glass panels 4, as shown in FIG. 4.

The horizontal glazing beads 42 are attached to the transom profile 14 by means of second attachment aids on the inside of the curtain wall 1 as shown in FIG. 4.

These second attachment aids 43 are PVC profiles with a profile length of approximately 3 cm. They are attached to the transom profiles 14 at intervals of about 60 cm and the horizontal glazing beads 42 are snapped onto the second attachment aids 43.

The upper edge 44 of the glass panels 4 is fitted between the glazing beads 15 on the outside of the curtain wall 1 and another horizontal glazing bead 45 on the inside which is provided with a rubber gasket 35 and which is snapped directly onto the transom profile 14.

It is noted that in some figures parts have been omitted to make other parts more visible. This is especially true of FIGS. 2 and 3, where in FIG. 2 mainly the sealing pieces 28, 29 and the ends of the transom profiles 14 are omitted, and in FIG. 3, mainly the glass panels 4, the vertical glazing beads 34 and the first attachment aids 36 for the vertical glazing beads 34 are omitted.

The manufacture and construction of the curtain wall 1 as described above is as follows.

First, the mullion profiles 5 and transom profiles 14 are prepared. At the positions where the transom profiles 14 are to be connected to the mullion profiles, the mullion profiles are provided with recesses 25, especially in the walls 26 defining the access opening 12 of the lateral grooves 9, 10. This is shown by means of shading in FIG. 6, which indicates where material of the mullion profiles 5 is removed, for example by milling. The obtained result is shown in FIG. 7.

The transom profiles 14 are also prepared. At their ends, a part of the transom profile 14 is milled for a length of about 11 mm. Shading indicates this part in FIG. 8.

These steps are normally, but not necessarily, automated and performed in a specialized workshop before the profiles 5,14 are transported to the location where the curtain wall 1 is to be built.

Next, the required glass supports 40 and second attachment aids 43 are provided in a groove routed for this purpose in the first leg 16.

Subsequently, sealing pieces 28, 29 are slid on the ends. These are shown in FIGS. 9 and 10 and exist in two variants, i.e. a first variant 28 as shown in FIG. 9, to be placed on the end of a transom profile intended to be fitted into the shallow lateral groove 10 of the mullion profiles 5 and a second variant 29, as shown in FIG. 10, to be placed on the end of a transom profile 14 intended to be fitted in the deep lateral groove 9 of the mullion profiles 5.

The pre-assembled sealing pieces 28, 29 attached to the transoms both have an upper surface 46 formed from planes slanting to a lowest point 47 away from the bottom 9' or 10', respectively of the grooves 9 and 10 in which the sealing pieces 28, 29 are fitted. Also, both sealing pieces 28, 29 have a recess 48 for receiving the ends of the transom profiles 14 with two ridges 49 with corresponding positions and formats relative to the chambers 23 in the transom profiles 14.

These recesses 48 do not fully extend through the sealing pieces 28, 29. The walls 51 perpendicular to the transom profiles 14, i.e. the rear walls in FIGS. 9 and 10, are completely closed. The sealing pieces 28, 29 sealingly fit with these walls 51 against the bottom 9' and 10' of a groove 9 or 10 in which they have been mounted.

In top view, the sealing pieces 28, 29 are sized to fit precisely in the lateral grooves 9, 10.

Both sealing pieces 28, 29 are also provided with air chambers 50, wherein at the position of the air chambers 50, the outer wall is relatively thin so that the air chambers 50 are deformable.

The sealing pieces 28 according to the first variant are fixed permanently onto the transom profiles 14, for example by means of glue. The sealing pieces 29 of the second variant are slid onto the transom profiles 14 and are not secured further onto the transom profiles 14.

Then a previously mentioned aluminium slat 32 is fitted into the undercut groove 30 of the second leg 17 at both ends of the transom profiles 14.

Next, the mullion profiles 5 are mounted in their desired position.

Hereafter, the transom profiles 14, in an orientation in which they are rotated about 60° on their longitudinal axis and in which they are not horizontal, are held in the plane defined by the mullion profiles 14, as shown in FIG. 11.

The transom profiles 14 are now brought to a horizontal orientation, as indicated by arrow P, with the ends being inserted into the lateral grooves 9, 10 of the mullion profiles 5. Due to the direction of rotation of the transom profiles 14, rotated around their profile direction, these ends easily fit in the access openings 12 of these lateral grooves 9, 10.

Then the transom profiles 14 are moved downwardly until they are in their desired position, i.e. at the recesses 25 in the mullion profiles 5. Then the transom profiles 14 are rotated as indicated by arrow Q. The situation as shown in FIG. 12 is now reached.

Figure 12:
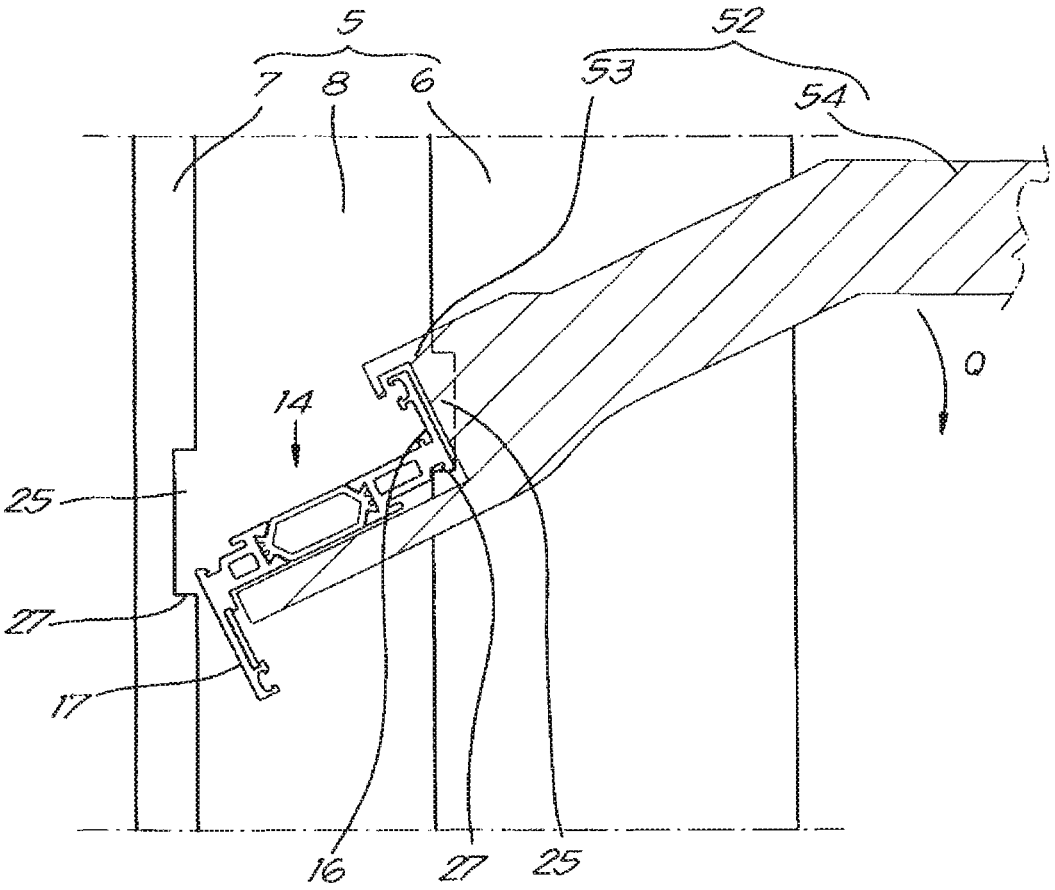
FIG. 12 schematically represents in cross-section analogous to FIG. 5 a next step in the manufacturing process of the curtain wall of FIG. 1.

The transom profiles 14 need to be rotated even further, starting from the situation as shown in FIG. 12. Because this requires relatively much force, preferably a tool 52 is used. This is a tool 52 with a head 53 with a partially complementary shape to the transom profile 14 and a lever 54 attached to the head 53. The lever 54 of the tool 52 is moved in the direction of arrow Q until the transom profile 14, as shown in FIGS. 4 and 5, is positioned in its end orientation in the recesses 25.

The sealing pieces 28, 29, more specifically their air chambers 50, deform considerably during this operation, but resume their original shape when the transom profile 14 is in its final orientation. The sealing pieces 28, 29 hereby completely close the lateral grooves 9, 10 in the vertical direction.

Next, the glazing beads 15 are attached with the gaskets 35 to the sub-profile 20 of the transom profiles 14 on the outside of the curtain wall. This can easily be done from the inside of the curtain wall using the clips 21.

Figure 13:
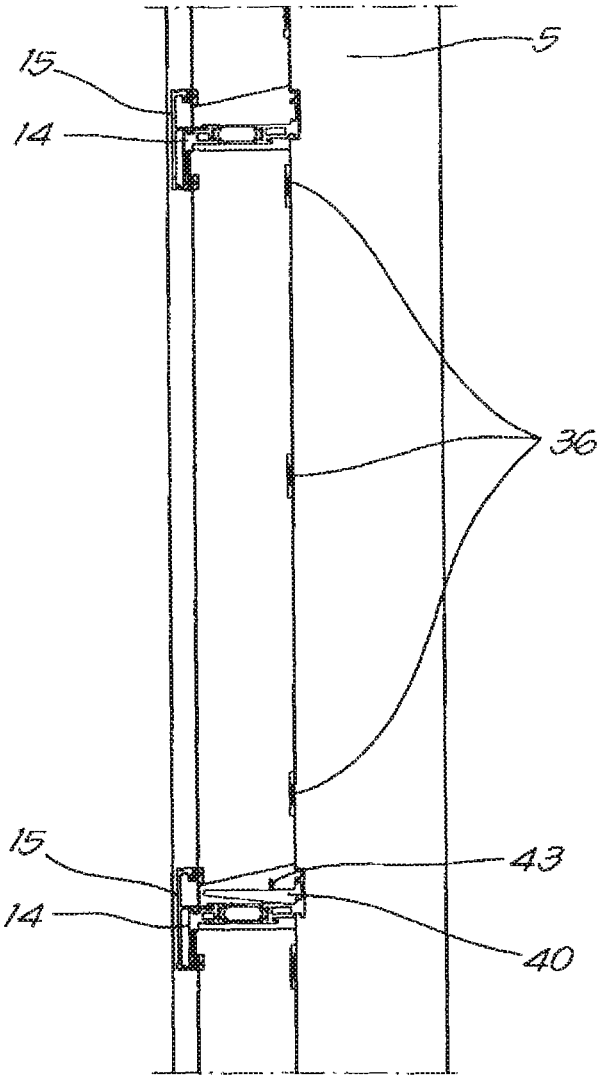
FIGS. 13 and 14 schematically represent in side view, and top view respectively, a next step in the manufacturing procedure of the curtain wall of FIG. 1, and FIGS. 15 and 16, schematically represent in side view, and top view respectively, a next step in the manufacturing procedure of the curtain wall of FIG. 1.
Figure 14:
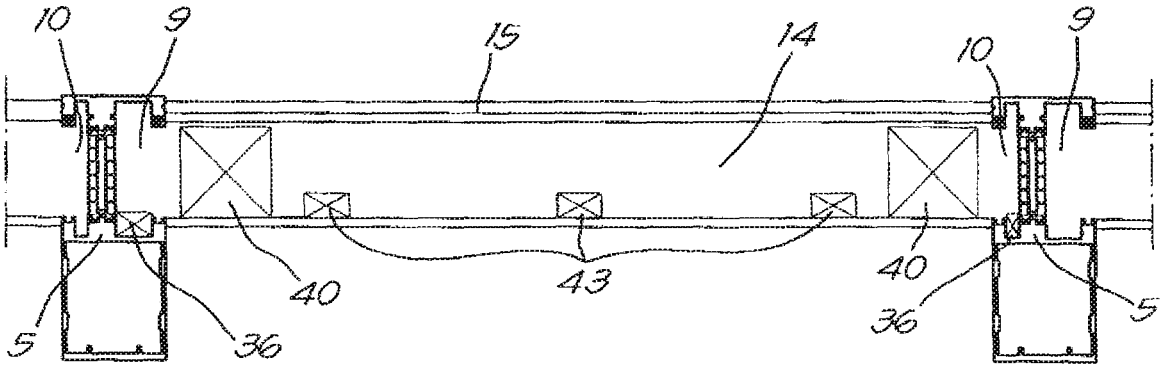

The glass supports 40 are pushed into their desired place, i.e. about 20 mm from the mullion profiles 5, and second attachment aids 43 are shifted until they are spread out over the length of the transom profiles 14, and the first attachment aids 36 for the vertical glazing beads 34 are snapped into their place as shown schematically in FIGS. 13 and 14.

The glazing beads are already provided with rubber gaskets 35 and neoprene blocks 55 are glued onto the glass supports 46, as shown in FIG. 5.

The slats 32 in the undercut grooves are pushed outwardly until they slide with an end into the second groove 13. They are then fixed in that position, for example with a little glue or by a screw. The transom profiles 14 can now no longer separate from the mullion profiles 5.

The construction can now be provided with glass panels 4.

Figure 15:
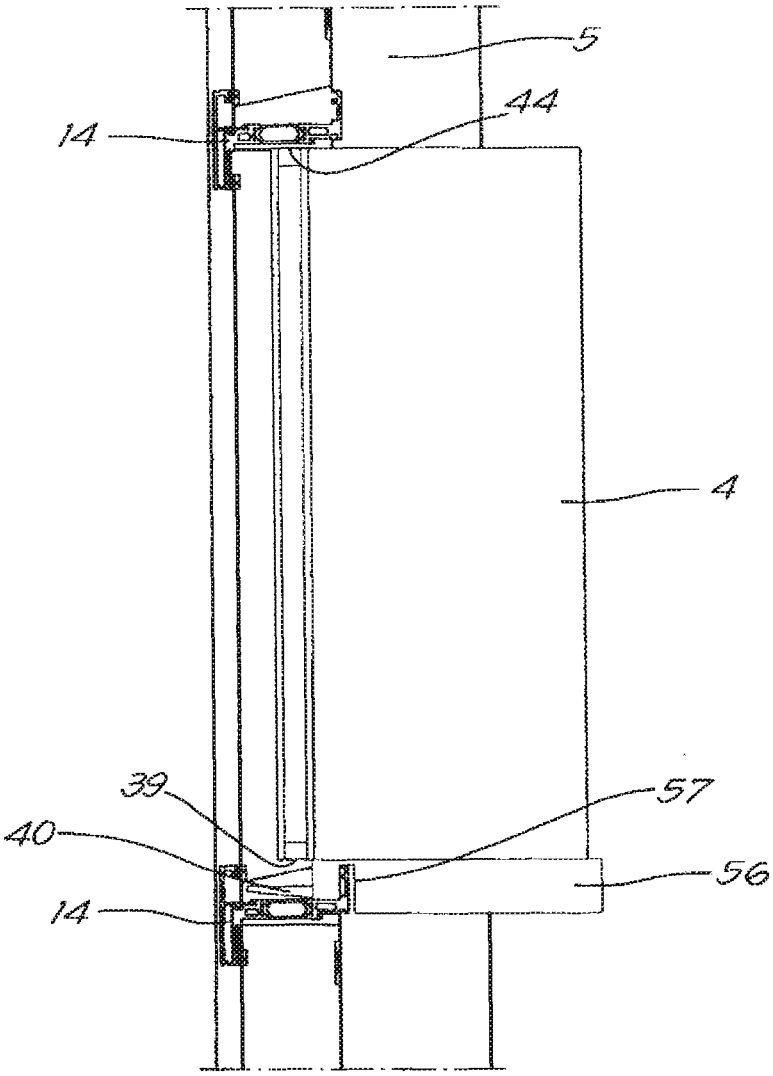
Figure 16:
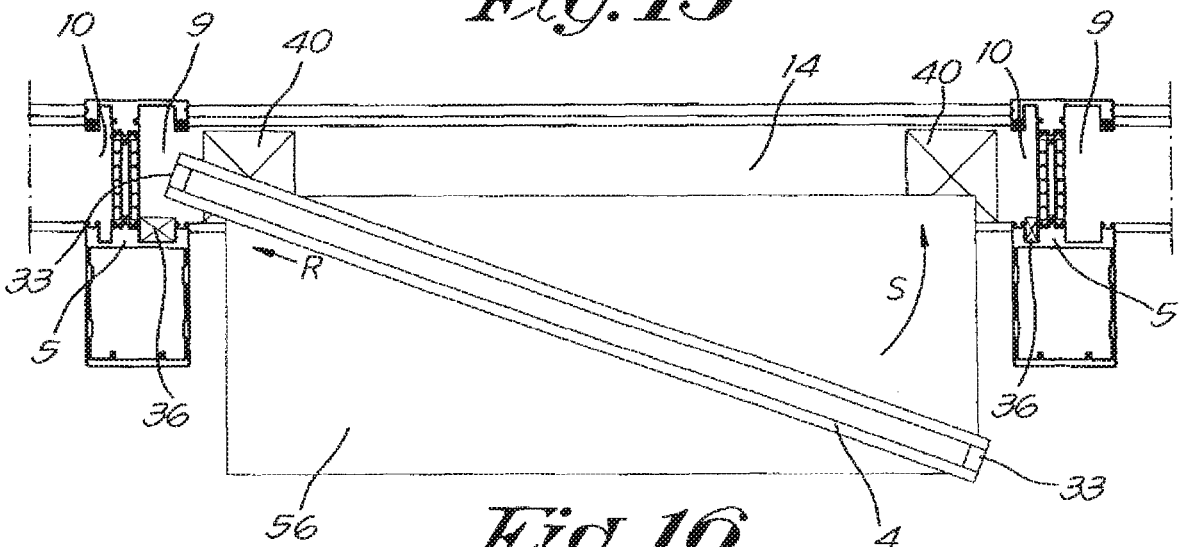

First, a wooden block 56 with a recess 57 for the first leg 16 is temporarily placed over the first leg 16. On top of this a glass panel 4 is placed in a slanted orientation. This is illustrated in FIGS. 15 and 16. The side edge 33 of the glass panel 4 that fits in the deep lateral groove 9 is now shuffled into this lateral groove 9 as indicated by arrow R.

Next, the other side edge 33 is shuffled along the opposite mullion section 5 as indicated by arrow S. To this end, the depth D1 of the groove 9 must be sufficient to shuffle the glass panel 4 sufficiently deep into this groove 9 with a pivotal movement of the glass panel 4 towards the shallow groove 10 and to then shuffle the glass panel 4 to the right, so that the glass panel 4 fits with both side edges 33 about 10 mm into a groove 9 or 10.

Then the glass panel 4 is centered so that it fits approximately 10 mm into both lateral grooves 9, 10 and then it is lowered onto the neoprene blocks 55. The wooden block 56 can now be removed.

Next, the horizontal and vertical glazing beads 34, 42, and their gaskets 35 can be applied. The glazing beads 34, 42, 45 can simply be snapped into place along the inside of the curtain wall 1. At the upper horizontal glazing bead 45, this is done directly onto the transom profile 14. The lower horizontal glazing bead 42 is snapped onto the second attachment aids 43 and through this onto the transom profile 14. The vertical glazing beads 34 are snapped onto the first attachment aids 36 and through this onto the mullion profile 4.

Now the final curtain wall 1, as shown in FIGS. 1 to 5, is built.

It is noted that, outside of the parts where the glass supports 40 are attached and located just next to the mullion profiles 5, the transom profiles 14 have no bearing function for the glass panels 4.

If water reaches the horizontal gaskets 35 on the outside, this water is diverted to the outside through the drainage openings 24 into the glazing beads 15 as shown in FIG. 5. If water gets to the vertical gaskets 35 into the lateral grooves 9, 10, it is diverted via the upper surfaces 46 of the sealing pieces 28 and 29 to the transom profiles 14 and from there it is drained to the outside via the drain openings 24 in the glazing beads 15.

If wind or other causes engender slight deformations of the curtain wall 1, the transom profiles 14 can slide a few millimetres into the sealing pieces 29 according to the second variant, which causes less stress to the curtain wall 1. Movements and deformation can also be absorbed by rubber sealing pieces 28 and 29 without jeopardizing the waterproofness of the curtain wall 1.

Although the construction method described above is done from the inside, it is also possible from the outside, although an installation from the inside usually has advantages.

The present invention is by no means limited to the embodiment described as an example and shown in the drawings, but a curtain wall according to the invention can be realized in all kinds of variants, without departing from the scope of the invention, as defined by the claims.

The invention claimed is:

1. A curtain wall comprising:

mullion profiles, transom profiles and one or more panels, wherein the mullion profiles are monolithic profiles that extend vertically, wherein the transom profiles each are attached to two mullion profiles and extend horizontally, wherein the mullion profiles are provided with a groove on each side for receiving a side edge of the one or more panels, wherein the grooves have an access opening, wherein the access opening has a first fixed dimension or width in a horizontal direction, wherein the transom profiles have a second dimension in a horizontal direction and at right angles to a length direction of the transom profiles, wherein the second dimension is larger than the first dimension, wherein the transom profiles have a third dimension in a non-horizontal direction at right angles to the length direction, wherein the third dimension is smaller than the first dimension, wherein the transom profiles are provided with an undercut groove extending in the length direction and a rod inserted in the undercut groove, wherein the mullion profiles are provided with a second groove for receiving an end of said rod projecting beyond the undercut groove, thereby blocking a rotational movement of the transom profiles, wherein pre-assembled sealing pieces are slid close-fittingly on end faces in the length direction of the transom profiles, each sealing piece set sealingly in the groove of two opposing mullions and thus forming a seal between the end faces of the transom profiles and the corresponding mullion profiles, wherein the sealing pieces form a barrier for water, wherein the barrier is adapted to divert the water to the transom profiles, and wherein the transom profiles are adapted to drain the water to the outside of the curtain wall.

2. The curtain wall of claim 1, wherein one or more walls of the grooves are provided with a recess in which a section of the transom profiles is located, wherein the transom profiles are vertically supported by a bottom edge of said recess.

3. The curtain wall of claim 1, wherein the transom profiles are Z-profiles, with a first vertical leg directing upward and located on a side of the transom profile facing an interior of the curtain wall, a second vertical leg directing downwards and located on a side of the transom profile facing an exterior of the curtain wall and a horizontal intermediate section between the first leg and the second leg.

4. The curtain wall of claim 3, wherein the undercut groove with the rod is provided on the inside of the second leg.

5. The curtain wall of claim 3, wherein two opposite walls of the grooves are provided with a said recess wherein the first leg is located in a first of said recesses and the second leg is located in a second of the recesses.

6. The curtain wall of claim 1, wherein the sealing pieces are provided with an elastically deformable hollow chamber to facilitate the placement of the sealing pieces.

7. The curtain wall of claim 1, wherein the sealing pieces are slid onto and/or into the transom profiles.

8. The curtain wall of claim 1, wherein at least one of the sealing pieces of each transom profile is slidable on the respective end of the transom profile in the length direction of the transom profile in order to accommodate small movements.

9. The curtain wall of claim 1, wherein the sealing pieces comprise a flat end wall perpendicular to the length direction of the transom profiles, wherein the end wall is completely closed in the length direction of the transom profiles and rests against the bottom of a groove of a mullion profile.

10. The curtain wall of claim 1, wherein the mullion profiles and the transom profiles are composite profiles, each of which is composed of two or more sub-profiles, wherein the sub-profiles are not necessarily made of the same material.

11. The curtain wall of claim 1, wherein said grooves have a different depth on the different sides of the mullion profiles.

12. A set for building a curtain wall, the set comprising:

two or more mullion profiles and two or more transom profiles, wherein the mullion profiles are monolithic profiles having an outer side, an inner side and two sides, wherein the mullion profiles are provided on each side with a groove for receiving a side edge of a panel, wherein the grooves have an access opening, wherein the access opening has a horizontal first dimension, wherein the transom profiles have a horizontal second dimension perpendicular to the length direction of the transom profiles, wherein the second dimension is larger than the first dimension, wherein the transom profiles have a third maximum dimension in a non-horizontal direction at right angles to the length direction of the profile, wherein the third dimension is smaller than the first dimension, wherein the transom profiles are provided with an undercut groove with a rod inserted in the undercut groove and wherein the mullion sections are provided with a second groove for receiving an end of the above-mentioned rod projecting out from the groove, thereby blocking a rotational movement of the transom profiles, wherein pre-assembled sealing pieces are slid close-fittingly on end faces in the length direction of the transom profiles, each sealing piece set sealingly in the groove of two opposing mullions and thus forming a seal between the end faces of the transom profiles and the corresponding mullion profiles, wherein the sealing pieces form a barrier for water, wherein the barrier is adapted to divert the water to the transom profiles, and wherein the transom profiles are adapted to drain the water to the outside of the curtain wall.

13. The set of claim 12, wherein one or more walls are provided with a recess for receiving a part of the transom profiles, wherein the transom profiles, when mounted, are vertically supported by a bottom edge of said recess.

14. The set of claim 12, wherein the transom profiles are Z-profiles, with a first vertical leg directing upwards when mounted and located on the inside of the transom profile, a second vertical leg which directs downwardly when mounted and is located on the outside of the transom profile, and an intermediate section that, when installed, is mounted horizontally between the first leg and the second leg.

15. The set of claim 12, wherein the set also comprises a tool having a head and a lever attached to the head, wherein the shape of the head is complementary to the shape of the transom profile so that the head can be fitted to the transom profile.

16. A method of constructing a curtain wall of claim 1, in which mullion profiles are placed vertically, in which a transom profile is subsequently placed horizontally between two adjacent mullion profiles, wherein the mullion profiles are provided on each side with a groove for receiving the side edge of a panel, wherein the grooves have an access opening, wherein the access opening has a horizontal first dimension, wherein the transom profiles have a horizontal second dimension perpendicular to a length direction of the transom profiles, wherein the second dimension is larger than the first dimension, wherein the transom profiles have a third maximum dimension in a non-horizontal direction at right angles to the length direction of the profile, wherein the third dimension is smaller than the first dimension, wherein the transom profiles are provided with an undercut groove with a rod inserted in the undercut groove and wherein the mullion sections are provided with a second groove for receiving an end of the above-mentioned rod projecting out from the groove, thereby blocking a rotational movement of the transom profiles, wherein pre-assembled sealing pieces are slid close-fittingly on end faces in the length direction of the transom profiles, each sealing piece set sealingly in the groove of two opposing mullions and thus forming a seal between the end faces of the transom profiles and the corresponding mullion profiles, wherein the sealing pieces form a barrier for water, wherein the barrier is adapted to divert the water to the transom profiles, and wherein the transom profiles are adapted to drain the water to the outside of the curtain wall, wherein this transom profile is placed by sequencing the following steps:

Step A) the transom profile is held in the vertical plane defined by the mullion profiles in a non-horizontal orientation with respect to the length direction of the transom profile;

Step B) the transom profile is rotated relative to the desired end orientation around an axis parallel to the length direction of the transom profile such that the non-horizontal direction of the transom profile having a third dimension is lined up with the access openings of the grooves;

Step C) the transom profile is brought to a horizontal orientation with respect to the length direction of the transom profile in the vertical plane defined by the mullion profiles, thereby inserting the end faces of the transom profile comprising the sealing pieces into the grooves;

Step D) the transom profile is rotated to the desired end orientation on said axis such that the sealing pieces are set sealingly in the grooves while the transom profile remains in a horizontal orientation with respect to the length direction of the transom profile;

Step E) blocking the rotation of the transom profile around said axis by shifting a rod in the undercut groove of the transom profile into a second groove of a mullion profile.

17. The method of claim 16, wherein a tool is used in step D with a head and a lever attached to the head, wherein the shape of the head is complementary to the shape of the transom profile, wherein the head is fitted to the transom profile in step D and in which a rotational force is applied to the transom profile via the lever.

* * * * *